US012345114B2

(12) United States Patent
Sundararajan et al.

(10) Patent No.: US 12,345,114 B2
(45) Date of Patent: Jul. 1, 2025

(54) ANNULAR BLOW OUT PREVENTER

(71) Applicant: SRI ENERGY, INC., Sugar Land, TX (US)

(72) Inventors: Alagarsamy Sundararajan, Sugar Land, TX (US); Subhra Dey, Sugar Land, TX (US); Aravindhan Rajamarthandan, Sugar Land, TX (US)

(73) Assignee: SRI ENERGY, INC., Sugar Land, TX (US)

( * ) Notice: Subject to any disclaimer, the term of this patent is extended or adjusted under 35 U.S.C. 154(b) by 0 days.

(21) Appl. No.: 18/903,594

(22) Filed: Oct. 1, 2024

(65) Prior Publication Data

US 2025/0116167 A1 Apr. 10, 2025

Related U.S. Application Data

(60) Provisional application No. 63/542,792, filed on Oct. 6, 2023.

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/062; E21B 33/601
See application file for complete search history.

(56) References Cited

U.S. PATENT DOCUMENTS

| | | | | |
|---|---|---|---|---|
| 1,839,394 | A * | 1/1932 | Inge | E21B 33/06 277/327 |
| 2,124,015 | A * | 7/1938 | Stone | E21B 33/06 251/1.1 |
| 2,163,813 | A * | 6/1939 | Stone | E21B 33/06 277/318 |
| 3,323,773 | A * | 6/1967 | Walker | E21B 33/06 277/327 |
| 3,897,038 | A * | 7/1975 | Le Rouax | E21B 33/06 251/1.2 |
| 5,116,017 | A * | 5/1992 | Granger | E21B 33/06 277/327 |
| 5,507,465 | A | 4/1996 | Borle | |
| 8,522,864 | B1 | 9/2013 | Miller | |
| 10,309,182 | B2 | 6/2019 | Jones et al. | |
| 2004/0178381 | A1* | 9/2004 | Sundararajan | F16K 3/0227 251/175 |

(Continued)

FOREIGN PATENT DOCUMENTS

WO 1984004130 A1 10/1984

OTHER PUBLICATIONS

International Searching Authority, International Search Report and Written Opinion dated Jan. 8, 2025 in PCT Application No. PCT/US2024/049442 (9 pages).

*Primary Examiner* — Shane Bomar
(74) *Attorney, Agent, or Firm* — Trop, Pruner & Hu, P.C.

(57) ABSTRACT

An embodiment uses a symmetrical elastomeric design with hydraulic pistons on either end (as opposed to a single piston on conventional BOPs) which allows for lower actuation forces, reduced friction, and reduced wear and tear. The lower actuation forces correspond to lower operating pressures which allows the body and housing to be smaller, leading to a smaller footprint.

19 Claims, 4 Drawing Sheets

(56) References Cited

U.S. PATENT DOCUMENTS

| | | | | |
|---|---|---|---|---|
| 2014/0048731 | A1* | 2/2014 | Leuchtenberg | E21B 33/085 251/1.1 |
| 2016/0138352 | A1* | 5/2016 | Leba | E21B 21/08 166/377 |
| 2018/0030805 | A1* | 2/2018 | Garcia | E21B 33/06 |
| 2019/0178047 | A1* | 6/2019 | Franks | E21B 33/1216 |
| 2019/0360288 | A1* | 11/2019 | Brown | E21B 33/1293 |
| 2021/0348470 | A1 | 11/2021 | Tenorio et al. | |
| 2022/0178219 | A1* | 6/2022 | Akhare | E21B 33/06 |

* cited by examiner

ANNULAR BLOW OUT PREVENTER

CROSS-REFERENCE TO RELATED APPLICATION

This application claims priority to U.S. Provisional Patent Application No. 63/542,792 filed on Oct. 6, 2023 and entitled "Annular Blow Out Preventer", the content of which is hereby incorporated by reference.

TECHNICAL FIELD

Embodiments of the invention are in the field of oil and gas production and, in particular, blow out preventors (BOP).

BACKGROUND

An annular BOP is a large sealing component that is placed on the wellhead to seal, control and monitor oil and gas wells. They have a rubber/elastomeric packing element which is energized by a hydraulic piston to close around a drill pipe or close in on itself for full shutoff of fluid flow from the well.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

DETAILED DESCRIPTION

Figure 1:
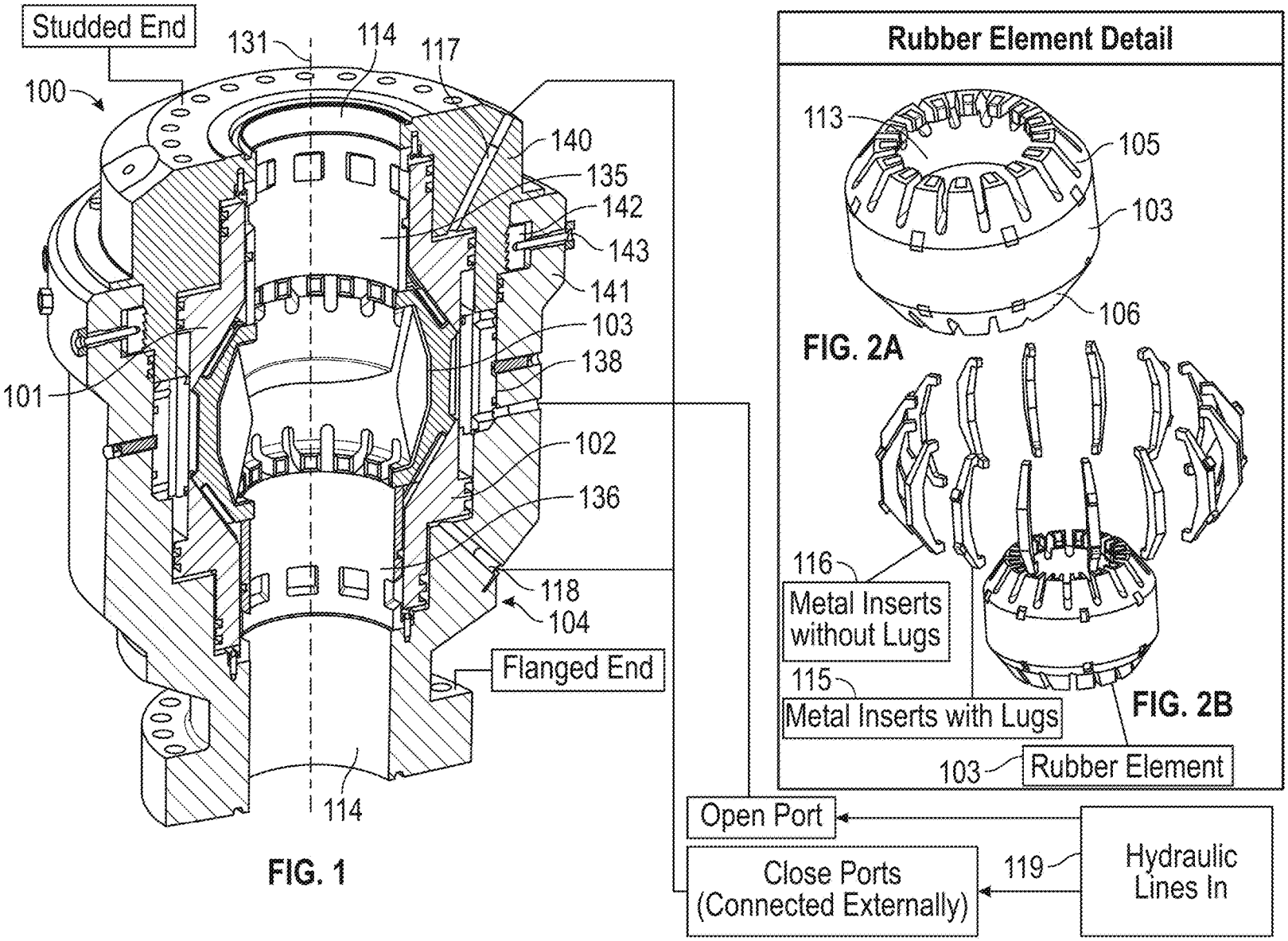
FIG. 1 includes a cross-sectional view of an embodiment.
Figure 2A:
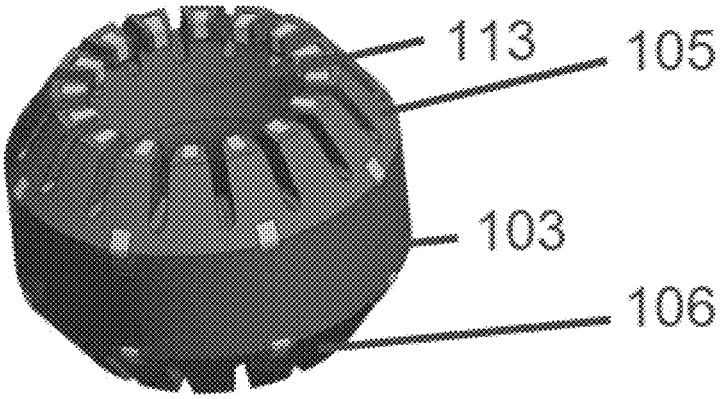
FIG. 2A includes a view of an embodiment of a resilient element with stiff bars included therein.
Figure 2B:
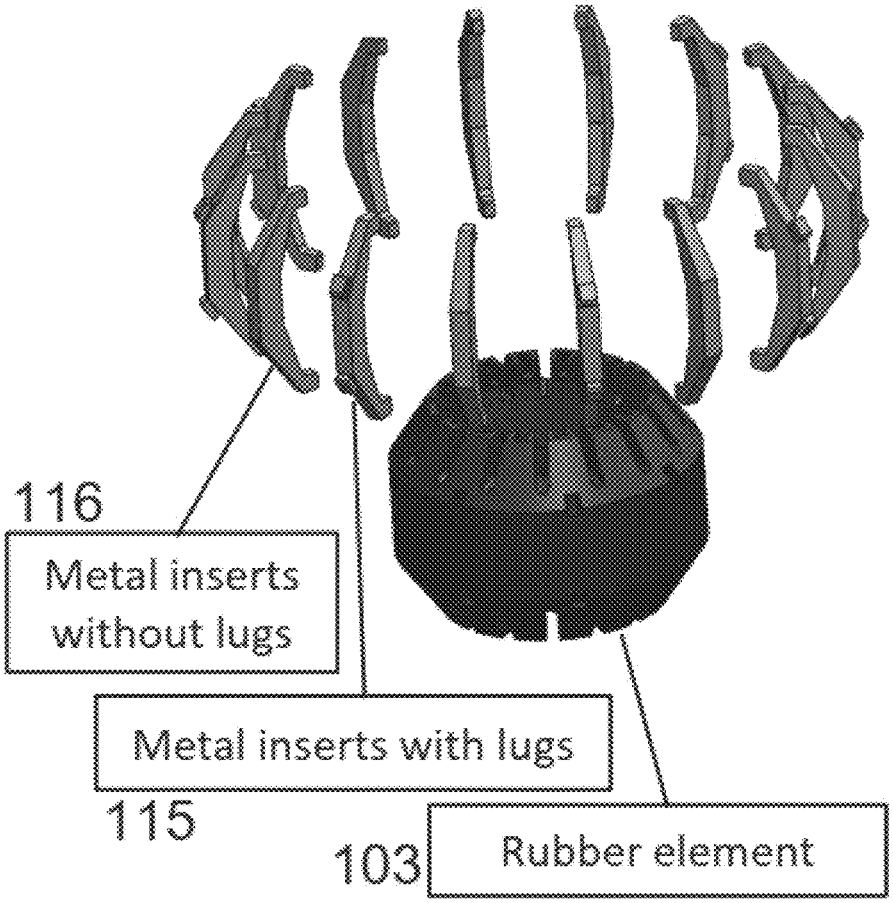
FIG. 2B includes an exploded view of the resilient element and bars.

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photo, may appear different while still incorporating the claimed structures of the illustrated embodiments (e.g., walls may not be exactly orthogonal to one another in actual fabricated devices). Moreover, the drawings may only show the structures useful to understand the illustrated embodiments. Additional structures known in the art may not have been included to maintain the clarity of the drawings. For example, not every layer of a device is necessarily shown.

"An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A or B" include situations with A, B, or A and B.

An embodiment uses a symmetrical elastomeric design with hydraulic pistons on either end (as opposed to a single piston on conventional BOPs) which allows for lower actuation forces, reduced friction, and reduced wear and tear. The lower actuation forces correspond to lower operating pressures which allows the body and housing to be smaller, leading to a smaller footprint.

More generally, Applicant identified the following problems with conventional BOPs: (1) excessive and premature wear and tear on the BOP's rubber element, (2) frequent need to replace the wear plate the BOP rubber element contacts when closing the BOP, (3) high operating forces needed to compress the rubber element and close the BOP, (4) the extended time need to open the BOP after closing it (sometimes taking 30 to 45 minutes) while the rubber element decompresses, (5) piston surface damage due to wear and tear, and (6) the asymmetrical nature of conventional BOPs leads to a need to store different parts for either end of the BOP.

However, Applicant determined several solutions to the above problems. For example, on conventional annular BOPs, the rubber element is actuated by a piston from the bottom. The rubber element has an angled bottom matching the piston face. Upon actuation, the element is pushed up against a horizontal wear plate, and then compresses inwards to seal against a pipe or fully close the BOP. This causes very high forces to act on the rubber, which wears out and deforms after a few cycles. This is especially a problem for deep sea projects. In contrast, an embodiment improves this condition by using two symmetrical pistons that act simultaneously on the element from opposing ends of the rubber element. The rubber element, essentially, stays in place and is compressed from either end to close and seal the BOP. Since both pistons have conical faces, and the element is tapered as well on both sides, the frictional forces are far less, which leads to lower forces involved to close the BOP and a longer life and reduced downtime for maintenance. Thus, in some embodiments, no wear plate is included or necessary to directly contact the resilient element.

Further, on conventional BOPs the top cap has a built-in wear plate which is designed to be consumed after a several cycles and protect the top cap since the rubber element force is transmitted to it during actuation. However, an embodiment removes the need for this wear plate since the element is arrested in between two symmetrical pistons and is contained between the two pistons. Forces transmitted to the element are lower and the conical faces of the element transfers most of this force to the element itself causing the element to move inwards towards centerline.

In addition, conventional BOPs require a high operating force to close the BOP. Closing the BOP involves a single piston forcing the rubber element against a flat surface, compressing it and energizing it inwards to seal. However, an embodiment requires lower operating forces (and hydraulic operating pressures) since there are 2 pistons sharing the load and the angled conical faces leading to lower frictional forces to overcome. The lower hydraulic pressures required to actuate the pistons allows for the design to have smaller wall thickness and the overall diameter of the BOP is smaller. This reduces its footprint and weight, leading to easier handling and fitting into tighter areas on the wellhead. For example, if a conventional BOP wall thickness is around 12 inches to 15 inches with an overall diameter of about 78 inches, an embodiment may instead have a maximum BOP wall thickness of about 8.95 inches with an overall diameter of about 64 inches. An embodiment includes a BOP wall thickness of between 6 inches to 10 inches with an overall diameter of about 55 inches to 65 inches.

Also, on conventional designs described above, the BOP is opened by moving the piston down using hydraulic pressure on the other side. This moves the piston out of the way and allows the rubber element to relax. The time taken by the rubber element to relax naturally and completely return back to its original position is very long, sometimes between 30 and 45 minutes. However, an embodiment addresses this using dovetail grooves on the pistons and protruding metal lugs from the rubber element which are molded into the rubber. These metal lugs essentially act as keys inside the keyways of the two pistons, locking the rubber element mechanically to the pistons. When closing the BOP, each piston transfers compression forces to the rubber element and the metal lugs inside the grooves simultaneously, thereby compressing the rubber and closing the annular BOP. The pistons may do so simultaneously with one another or, in other embodiments, not simultaneously with each other (where in the pistons may operate independently of each other). When opening the BOP, hydraulic forces from the middle portion of the BOP push both pistons back and away from the rubber/resilient element thereby relaxing the element. And since the metal lugs are keyed into the dovetail grooves on the pistons, the movement of the pistons away from the element mechanically pulls the rubber element back to its original position, thereby stretching the element opening the BOP in a similar time to the time it takes to push the pistons out (e.g., approximately 30 seconds).

In an embodiment, one or more internal components of the BOP are symmetrical. The embodiment comprises two pistons, a rubber element, one or more waste baskets, and a stop ring in the middle of the BOP. This entire subassembly can be installed with either end of the BOP facing up. Such a BOP can be flipped around if required (e.g., damage is noticed on a sealing surface or seal ring). A symmetric design reduces the need to order different spares and lower quantities of the same parts can be kept on hand for maintenance.

Various features of the embodiment contribute to solving the above-mentioned problems.

First, symmetrical pistons allow forces needed to energize rubber element to be shared equally. Actuation from both ends of the element keeps the rubber element in place. Frustoconical faces on the pistons reduce friction forces and transfer forces more effectively to the rubber. Dovetail shaped grooves on the pistons lock the rubber element with the pistons and allow for faster opening times by mechanically pulling on the lugs on the rubber element during opening sequence.

Second, the resilient element (e.g., a rubber or elastomeric element) is the main sealing member of the BOP. It includes symmetrical frustoconical faces that taper towards each piston's internal diameter (ID). The resilient element has metal fingers molded within the rubber or other resilient material for integrity. This design involves alternating metal fingers to have metal lugs protruding out of the rubber with dovetail profiles on them matching the dovetail grooves on the piston faces. These emerging metal lugs/protuberances slide withing the piston grooves during opening and closing and the dovetail profile pulls the rubber into its non-compressed form during the piston's opening sequence.

Third, a hydraulic port to open the BOP is located in the middle of the body. Body 104 includes subcomponents head 140 and main body 141, as well as latch section 142 and latch bolts 143. Hydraulic fluid from this port pushes the pistons back out under pressure. The body also has a port to close the lower piston. The other closing port for the upper piston is located on the BOP head. These two closing ports are connected externally outside the BOP to act on the two pistons simultaneously. Moreover, the BOP body and head can be configured such that either end connections are flanged or studded.

EXAMPLES

The following examples pertain to, for example, FIGS. 1-4E.

Example 1. A blow out preventor (BOP) (100) comprises a first piston (101) including a central channel (111) that traverses the first piston. The BOP further includes a second piston (102) including a central channel (112) that traverses the second piston. Resilient ring (103) includes a central channel (113) that traverses the ring. Body (104) includes a central channel (114), the ring, and the first and second pistons. The channels of the body, the ring, and the first and second pistons align with each other.

The ring is between the first and second pistons and includes: (a) an upper surface (105) that tapers inwards as the upper surface extends upwards towards the first piston; (b) a lower surface (106) that tapers inwards as the lower surface extends downwards towards the second piston; (c) first and second upper slots (107, 108) on the upper surface and first and second lower slots (109, 110) on the lower surface; and (d) a first metal bar (115) included in both of the first upper and lower slots and a second metal bar (116) included in both of the second upper and lower slots.

The ring does not necessarily have to be circular in cross-section and need not necessarily be a ring that is contiguous along an cross-section. For example, various members may collectively cooperate to form a ring that can open and close to open and close a fluid path. Ball bearing systems and the like may be used to facilitate translating piston action to elements that move to open and close a fluid path.

Alternative version of Example 1. A blow out preventor (BOP) (100) comprising: a first actuator (101) including a central channel (111) that traverses the first actuator; a second actuator (102) including a central channel (112) that traverses the second actuator; a resilient ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105) that tapers inwards as the upper surface extends upwards towards the first actuator; (b) a lower surface (106) that tapers inwards at the lower surface extends downwards towards the second actuator; (c) first and second upper voids (107, 108) on the upper surface and first and second lower voids (109, 110) on the lower surface; and (d) a first beam (115) included in both of the first upper and lower voids and a second beam (116) included in both of the second upper and lower voids.

Thus, pistons are not necessarily required and, instead, more general actuators may be used. Further, metal bars are not necessarily required and instead, more general beams or other structures may be used. No particular material (e.g., metal, polymer, etc.) is required for the beams in various embodiments.

Alternative version of Example 1. A blow out preventor (BOP) (100) comprising: a first actuator (101) including a central channel (111) that traverses the first actuator; a second actuator (102) including a central channel (112) that traverses the second actuator; a resilient ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105) that tapers inwards as the upper surface extends upwards towards the first actuator; (b) a lower surface (106) that tapers inwards at the lower surface extends downwards towards the second actuator; (c) a first upper void on the upper surface and a first lower void on the lower surface; and (d) a first beam included in both of the first upper and lower voids.

Thus, no set number of beams and/or voids are required in various embodiments.

Alternative version of Example 1. A blow out preventor (BOP) (100) comprising: a first actuator (101) including a central channel (111) that traverses the first actuator; a second actuator (102) including a central channel (112) that traverses the second actuator; a resilient ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105); (b) a lower surface (106); (c) first and second upper voids (107, 108) on the upper surface and first and second lower voids (109, 110) on the lower surface; and (d) a first beam (115) included in both of the first upper and lower voids and a second beam (116) included in both of the second upper and lower voids.

Thus, tapering of the ring surfaces is not necessarily required in all embodiments.

Alternative version of Example 1. A blow out preventor (BOP) (100) comprising: a first actuator (101) including a central channel (111) that traverses the first actuator; a second actuator (102) including a central channel (112) that traverses the second actuator; a ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105) that tapers inwards as the upper surface extends upwards towards the first actuator; (b) a lower surface (106) that tapers inwards at the lower surface extends downwards towards the second actuator; (c) first and second upper voids (107, 108) on the upper surface and first and second lower voids (109, 110) on the lower surface; and (d) a first beam (115) included in both of the first upper and lower voids and a second beam (116) included in both of the second upper and lower voids.

Thus, the ring need not be "resilient" in all embodiments. In various embodiments, a ring may be compressible, elastic, and the like.

Alternative version of Example 1. A blow out preventor (BOP) (100) comprising: a first actuator (101) including a central channel (111) that traverses the first actuator; a second actuator (102) including a central channel (112) that traverses the second actuator; a resilient ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105) that tapers inwards as the upper surface extends upwards towards the first actuator; (b) a lower surface (106) that tapers inwards at the lower surface extends downwards towards the second actuator; (c) first and second upper protuberances on the upper surface and first and second lower protuberances on the lower surface; and (d) a first beam including both of the first upper and lower protuberances and a second beam including both of the second upper and lower protuberances.

Thus, no specific keying between beams and the ring is necessarily required and, for example, various male/female or female/male keying may be used in varying embodiments.

Alternative version of Example 1. A blow out preventor (BOP) (100) comprising: a first actuator (101) including a central channel (111) that traverses the first actuator; a second actuator (102) including a central channel (112) that traverses the second actuator; a resilient ring (103) including a central channel (113) that traverses the ring; and a body (104) that includes a central channel (114), the ring, and the first and second actuators; wherein the channels of the body, the ring, and the first and second actuators align with each other; wherein the ring is between the first and second actuators and includes: (a) an upper surface (105) that tapers inwards as the upper surface extends upwards towards the first actuator; (b) a lower surface (106) that tapers inwards at the lower surface extends downwards towards the second actuator; (c) a first void and a second void; and (d) a first beam included in the first void and a second beam included in the second void.

Thus, in various embodiments the voids do not need to be located in any one spot on the ring and no specific number of voids are required to interface any beam. And as mentioned above, keying mechanisms may be reversed to somehow translate action of the piston to action in the ring. Male/female protuberances/voids may be switched between actionable elements (e.g., beams and ring) to translate the piston action to open and close the channel.

Example 2. The BOP of example 1 comprising: a first hydraulic port (117) in communication with an upper surface of the first piston; a second hydraulic port (118) in communication with a lower surface of the second piston; wherein the first and second hydraulic ports traverse the body.

Example 3. The BOP of example 2 wherein the first and second hydraulic ports are configured to fluidly couple to a hydraulic source (119). In response to increasing hydraulic pressure from the hydraulic source, the first and second hydraulic ports are configured to simultaneously and respectively move the first piston down and the second piston up to compress the ring.

Figure 3B:
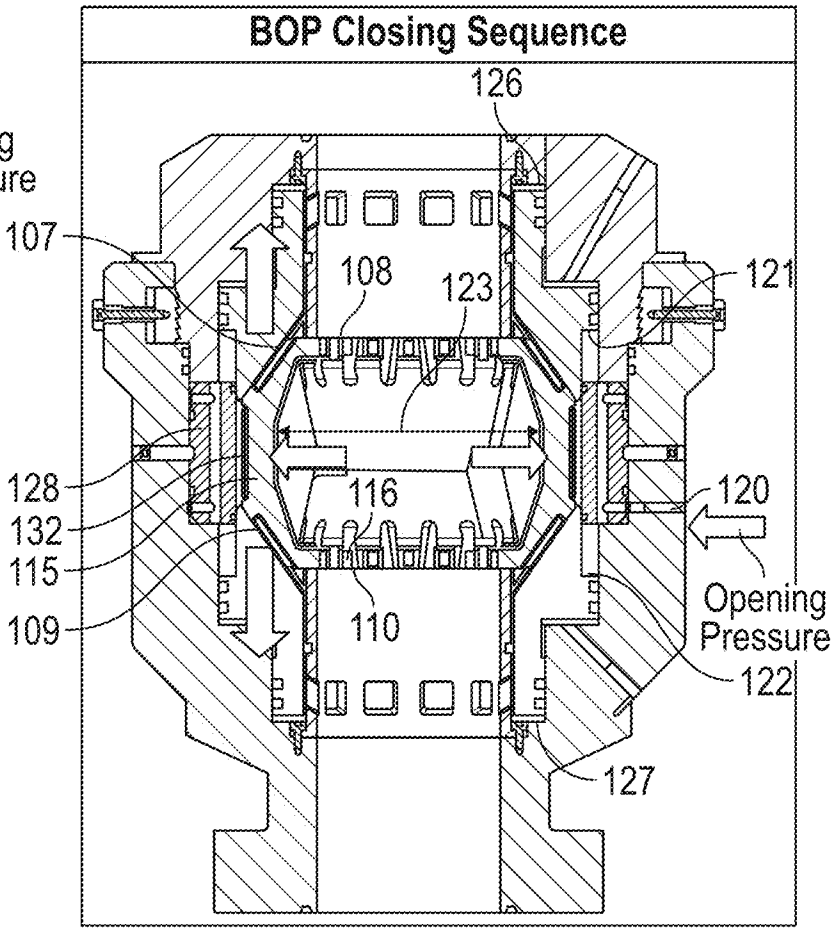
FIG. 3A includes a cross-sectional view of an embodiment in a closed configuration and FIG. 3B includes a cross-sectional view of the embodiment in an open configuration.
Figure 3A:
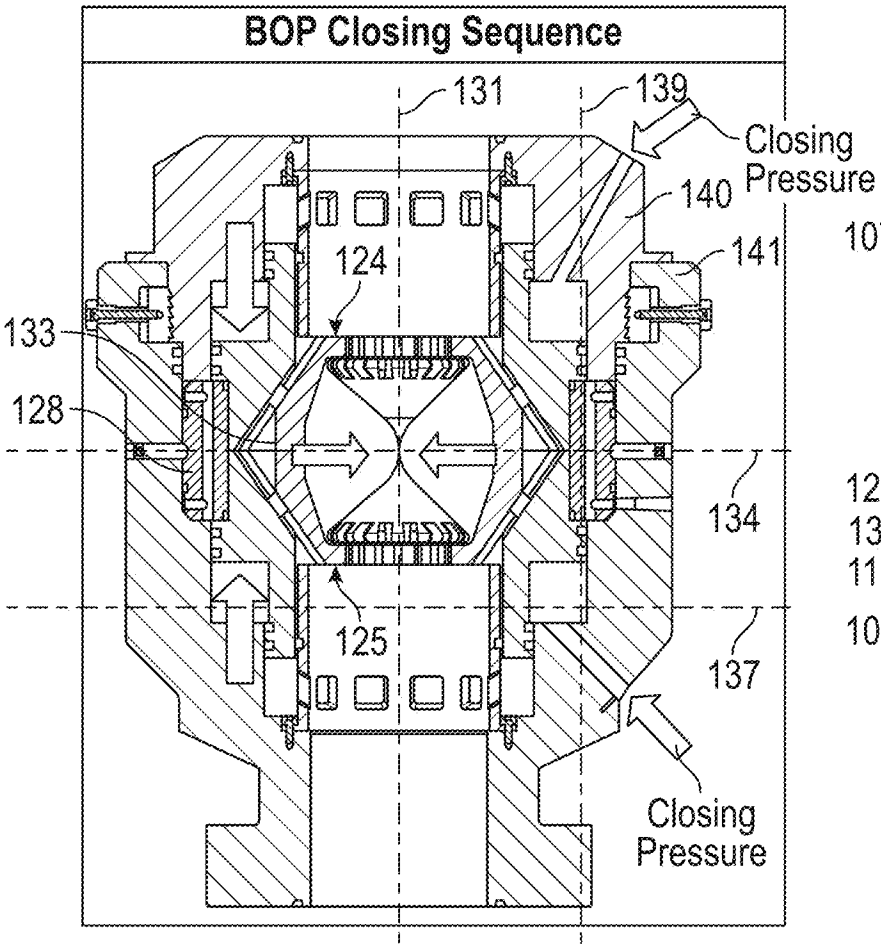

For example, see FIG. 3A wherein closing pressure causes the first and second hydraulic ports to simultaneously and respectively move the first piston down and the second piston up to compress the ring.

As used herein, "simultaneously" just means first and second pistons are both moving at at least one point in time. They do not need to necessarily start and/or stop the movement at the same exact time or times.

Example 4. The BOP of example 1 comprising a first hydraulic port in communication with an upper surface of the first piston and a lower surface of the second piston; wherein the first hydraulic port traverses the body.

Thus, although not illustrated, in an embodiment a single port may be routed to communicate with both of the first and second pistons. Use of "first" in this instance or more generally herein does not necessarily indicate a "second" article is required.

Example 5. The BOP of example 4 wherein: the first hydraulic port is configured to fluidly couple to a hydraulic source; in response to increasing hydraulic pressure from the hydraulic source, the first hydraulic port is configured to simultaneously and respectively move the first piston down and the second piston up to compress the ring.

Example 6. The BOP according to any of examples 2-5 comprising: a third hydraulic port (120) in communication with a lower surface (121) of the first piston and an upper surface (122) of the second piston; wherein the third hydraulic port traverses the body.

For example, see FIG. 3B.

Example 7. The BOP of example 6 wherein the third hydraulic port is configured to fluidly couple to at least one of the hydraulic source and an additional hydraulic source. In response to increasing hydraulic pressure from the at least one of the hydraulic source and the additional hydraulic source, the third hydraulic port is configured to simultaneously and respectively move the first piston up and the second piston down to decompress the ring.

For example, see FIG. 3B.

Example 8. The BOP according to any of examples 2-5 comprising a third hydraulic port in communication with a lower surface of the first piston, and a fourth hydraulic port in communication with an upper surface of the second piston. The third and fourth hydraulic ports traverse the body.

While not shown, in some embodiments separate ports may be used to communicate with the first and second pistons to decompress the resilient ring.

Example 9. The BOP of example 8, wherein the third and fourth hydraulic ports are configured to fluidly couple to at least one of the hydraulic source and an additional hydraulic source. In response to increasing hydraulic pressure from the at least one of the hydraulic source and the additional hydraulic source, the third and fourth hydraulic ports are configured to simultaneously and respectively move the first piston up and the second piston down to decompress the ring.

Example 10. The BOP according to any of examples 1-9, wherein in an open configuration the central channel of the ring includes a first inner diameter (123). In a closed configuration the ring is compressed between the first and second pistons and the central channel of the ring includes a second inner diameter that is smaller than the first inner diameter.

For example, compare FIG. 3B with an open configuration and FIG. 3A with a closed configuration. Of course, there may be intermediate stages of choking wherein the inner diameter is between the fully open (FIG. 3B) and fully closed (FIG. 3A) stages.

Example 11. The BOP of example 10, wherein in the closed configuration the first and second pistons simultaneously directly contact the first and second metal bars.

For example, see areas 124, 125 of FIG. 3A. This prevents overly compressing ring 103, which would possibly lead to premature damage to the ring.

Example 12. The BOP according to example 10, wherein in the open configuration the first piston is adjacent a lower surface (126) of the body and the second piston is adjacent an upper surface (127) of the body. In the closed configuration the first and second pistons are both adjacent an additional ring (128) that encircles the ring.

This prevents overly compressing ring 103, which would possibly lead to premature damage to the ring. See, for example, how upper and lower portions of ring 128 prevent further closure by the pistons.

Example 13. The BOP according to any of examples 1-12 comprising a means for simultaneously keying the first and second piston to the first metal bar.

For example, see dovetail protuberance 129 and void 130, which is keyed to the dovetail. Such keying helps coordinate the sliding of the pistons over, for example, bar 115. Resistance to movement of pistons 101, 102 may be modified by not keying all bars. For example, bar 115 is keyed to pistons 101, 102 but bar 116 is not keyed.

Example 14. The BOP of example 13, wherein the first and second pistons are slidingly engaged with the first metal bar via the means for simultaneously keying the first and second piston to the first metal bar.

Example 15. The BOP according to any of examples 1-12 wherein the first and second pistons are slidingly coupled to the first metal bar via at least one slot and at least one protuberance.

Thus, a dove tail protuberance/void arrangement is not necessarily required in all embodiments.

Example 16. The BOP according to example 15, wherein in response to the first and second pistons being slidingly coupled to the first metal bar via the at least one slot and at least one protuberance, the ring is configured to expand simultaneously with the first and second pistons moving away from each other.

In essence, due to the keying the ring is pulled outward by the pistons moving away from each other.

Example 17. The BOP according to example 15, wherein the first piston includes a first slot (130) and the second piston includes a second slot. The first metal bar includes at least one protuberance (129) to fit within and slide within the first and second slots.

Example 18. The BOP according to example 15, wherein: the first metal bar includes at least one slot. The first piston includes at least one protuberance to fit within and slide within the at least one slot. The second piston includes at least one protuberance to fit within and slide within the at least one slot.

Figure 4A:
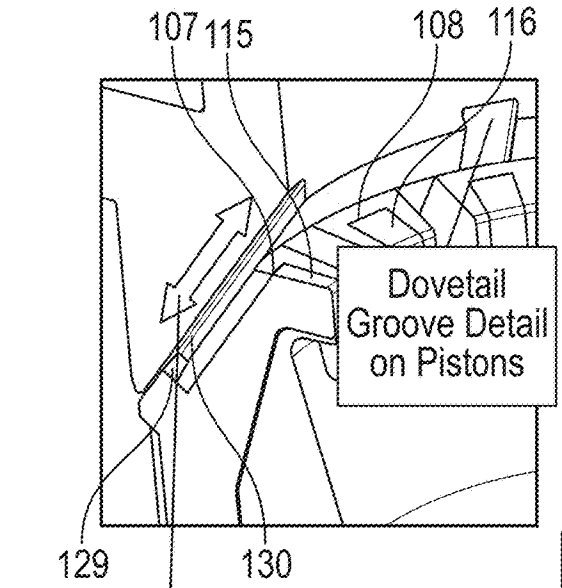
FIG. 4A includes a cross-sectional view of an embodiment wherein a bar, which is coupled to the resilient member, is configured to slide within a groove, slot, or void of a piston as the embodiment transitions between open and closed states.
Figure 4B:
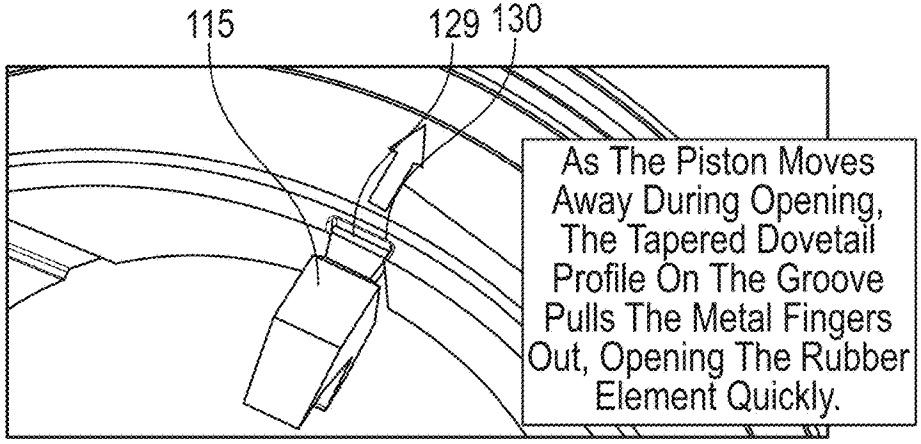
FIG. 4B provides a different view of the same.
Figure 4C:
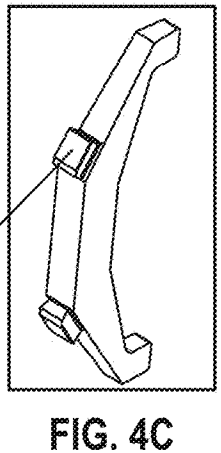
FIG. 4C is a view of the bar in isolation.
Figure 4D:
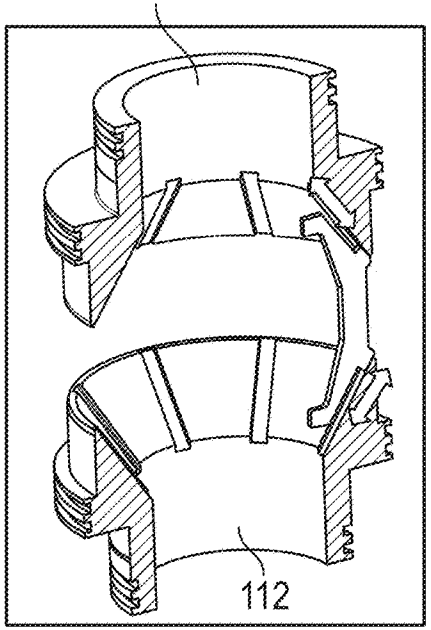
FIGS. 4D and 4E respectively show the sliding of the bar with regard to upper and lower pistons in both open and closed states.
Figure 4E:
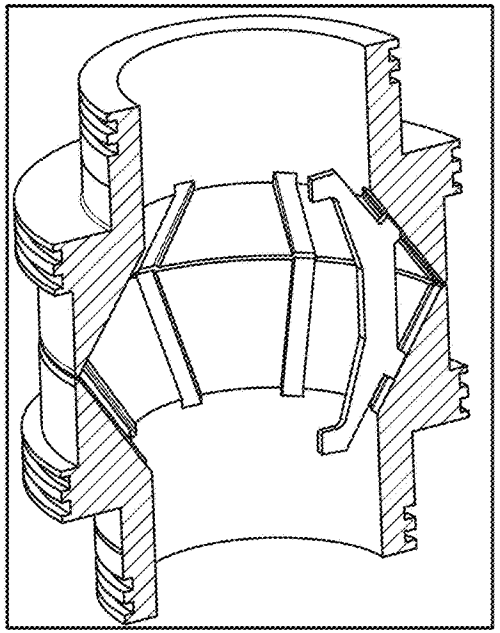

In other words, while FIG. 4B shows the piston with the slot and the bar with the protuberance, other embodiments may reverse this and instead have the piston with the bar and the bar with the slot, or other such keyed relationships.

Example 18.1. The BOP according to any of examples 1-17, wherein the first bar includes at least one of a slot or a protuberance. The first piston includes another of the at least one of a slot or a protuberance and is slidingly engaged with the first bar via the slot and protuberance. The second bar does not slidingly engage with the first piston via slot or protuberance.

Again, resistance to closing the bore may be managed by having some, but not all, bars slidingly engage with the piston or pistons. As an aside, one or both pistons may slidingly engage with the first bar. In some embodiments, the first piston may slidingly engage with slot or protuberance of the first bar but not the second bar and the second piston may slidingly engage with slot or protuberance of the second bar but not the first bar. Further, some embodiments may include slot/bar interfaces for one of the pistons but not both of the pistons.

Example 19. The BOP according to any of examples 1-18.1 wherein the ring includes at last one of rubber, an elastomer, or combinations thereof.

Example 20. The BOP according to any of examples 1-19 wherein the first and second pistons have identical forms to each other.

As a result, manufacturing difficulties and costs are reduced considering the pistons are interchangeable. Further, deploying the pistons in the field is also simplified and less inventory must be maintained (i.e., a single piston can suffice for replacement of either the upper or lower pistons instead of having unique piston forms for each of the upper and lower pistons).

Example 21. The BOP according to any of examples 1-20 wherein the upper surface of the ring is frustoconical and the lower surface of the ring is frustoconical.

As used herein, frustoconical includes truncated cones. The truncation may occur via a plane that is parallel to the wider base of the underlying cone. Other embodiments may include other forms for the resilient member, such as a frustospherical shape and the like (with a truncated portion of a sphere). For example, the ring may include a sphere whose upper and lower surfaces are truncated by planes parallel to each other.

Example 22. The BOP according to any of examples 1-21, wherein the BOP does not include a wear plate configured to contact the ring.

Example 23. The BOP according to any of examples 1-22 comprising a first axis (131) that traverses the channels of the body, the ring, and the first and second pistons but does not intersect any of the body, the ring, or either of the first or second pistons.

Example 24. The BOP according to any of examples 1-23 comprising a sub-assembly that includes the first and second pistons and the resilient ring. A second axis (134) is orthogonal to the first axis (131) and intersects the resilient ring. The sub-assembly is symmetrical above and below the second axis.

Example 25. The BOP of example 24, wherein the second axis bisects the resilient ring.

Example 26. The BOP according to any of examples 1-25, wherein the first piston has a first face slidingly engaged with the first metal bar. The second piston has a second face slidingly engaged with the first metal bar. The first and second faces are frustoconical.

Example 27. The BOP according to any of examples 1-26 comprising perforated first and second cylinders (135, 136) included in the central channel. At least a portion of the resilient ring is included between the first and second cylinders. A third axis (137) intersects one of the first and second cylinders and one of the first and second pistons. The third axis is parallel the second axis.

For example, waste baskets 135, 136 help filter large debris from entering voids within the body while still allowing for fluid flow into the body to distribute fluid pressure within the body.

Example 28. The BOP according to any of examples 1-27 comprising an additional ring (138), wherein the additional ring is between portions of the first and second pistons.

A fourth axis (139), which is parallel to the first axis, intersects the first and second pistons and the additional ring.

The additional ring may serve as a stop ring to limit the distance the first and second pistons may travel when closing the bore. While a ring is shown in FIG. 3A, other embodiments may use protuberances that are not rings yet still limit the travel of either or both of the pistons.

Example 30. A method comprising performing operations with the BOP according to any of examples 1-25, wherein the operations include: sealing a bore with the BOP and unsealing the bore with the BOP.

Example 31. The method of example 30, wherein sealing the bore with the BOP includes simultaneously moving the first piston down towards the ring and the second piston up towards the ring.

Example 32. The method according to any of examples 28-29, wherein unsealing the bore with the BOP includes: (1) simultaneously moving the first piston up away from the ring and the second piston down away from the ring; and (2) pulling the upper and lower surfaces of the ring away from each other in response to simultaneously moving the first piston up away from the ring and the second piston down away from the ring.

Example 33. The method according to any of examples 28-30 comprising initiating and completing unsealing the bore with the BOP in less than 5 minutes. This may entail transitioning from a completely closed bore to a completely open bore.

Example 34. The method according to any of examples 28-30 comprising initiating and completing unsealing the bore with the BOP in less than 1 minute. This may entail transitioning from a completely closed bore to a completely open bore.

Example 35. The method according to any of examples 28-30, wherein: (1) sealing the bore with the BOP includes moving an outermost portion of the ring from a first starting position (132) to a second ending position (133); and (2) unsealing the bore with the BOP includes moving the outermost portion of the ring from the second ending position to the first starting position in less than 5 minutes.

Position 132 may correspond to a fully open bore and position 133 may correspond to a fully closed bore.

While embodiments have generally depicted both pistons traveling or moving to compress the resilient ring and close the bore, other embodiments may operate the pistons separately so that only one of the two pistons moves. Thus, in a mode of operation the pistons may move simultaneously with each other but in another mode of operation the pistons may move independently of each other.

Also, while ring 103 is generally referred to as being resilient, the range of resilience is broad and, in some embodiments, the ring may not be resilient. Further, the resilient ring may be monolithic or be comprised of multiple resilient pieces. In an embodiment, the ring may include materials such as rubber (e.g., nitrile rubber), hydrogenated nitrile rubber (HNBR), or combinations thereof in varying ratios. Embodiments may vary material selection according to environmental conditions such as, for example, TFE/P rubber (e.g., copolymer of tetrafluoroethylene and propylene with a fluorine) for relatively higher temperature environments.

While numerical indicators are included in the above examples, those are merely examples and are not exclusive to other components that may relate to portions of examples.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the figures. It is therefore intended that the scope of the invention be limited not by this detailed description, but rather by the claims appended hereto.

What is claimed is:

1. A blow out preventor (BOP) comprising:

a first piston including a central channel that traverses the first piston;

a second piston including a central channel that traverses the second piston;

a resilient ring including a central channel that traverses the ring; and a body that includes a central channel, the ring, and the first and second pistons;

wherein the channels of the body, the ring, and the first and second pistons align with each other;

wherein the ring is between the first and second pistons and includes: (a) an upper surface that tapers inwards as the upper surface extends upwards towards the first piston; (b) a lower surface that tapers inwards as the lower surface extends downwards towards the second piston; (c) first and second upper slots on the upper surface and first and second lower slots on the lower surface; and (d) a first metal bar included in both of the first upper and lower slots and a second metal bar included in both of the second upper and lower slots.

2. The BOP of claim 1 comprising:

a first hydraulic port in communication with an upper surface of the first piston;

a second hydraulic port in communication with a lower surface of the second piston;

wherein the first and second hydraulic ports traverse the body.

3. The BOP of claim 2 wherein:

the first and second hydraulic ports are configured to fluidly couple to a hydraulic source;

in response to increasing hydraulic pressure from the hydraulic source, the first and second hydraulic ports are configured to simultaneously and respectively move the first piston down and the second piston up to compress the ring.

4. The BOP of claim 1 comprising a first hydraulic port in communication with an upper surface of the first piston and a lower surface of the second piston; wherein the first hydraulic port traverses the body.

5. The BOP of claim 4 wherein:

the first hydraulic port is configured to fluidly couple to a hydraulic source;

in response to increasing hydraulic pressure from the hydraulic source, the first hydraulic port is configured to simultaneously and respectively move the first piston down and the second piston up to compress the ring.

6. The BOP of claim 1, wherein:

in an open configuration the central channel of the ring includes a first inner diameter; and in a closed configuration the ring is compressed between the first and second pistons and the central channel of the ring includes a second inner diameter that is smaller than the first inner diameter.

7. The BOP of claim 6, wherein:

in the open configuration the first piston is adjacent a lower surface of the body and the second piston is adjacent an upper surface of the body;

in the closed configuration the first and second pistons are both adjacent an additional ring that encircles the ring.

8. The BOP of claim 1 comprising a means for simultaneously keying the first and second pistons to the first metal bar.

9. The BOP of claim 8, wherein the first and second pistons are slidingly engaged with the first metal bar via the means for simultaneously keying the first and second pistons to the first metal bar.

10. The BOP of claim 1 wherein the first and second pistons are slidingly coupled to the first metal bar via at least one slot and at least one protuberance.

11. The BOP of claim 10, wherein in response to the first and second pistons being slidingly coupled to the first metal bar via the at least one slot and at least one protuberance, the ring is configured to expand simultaneously with the first and second pistons moving away from each other.

12. The BOP of claim 1, wherein the BOP does not include a wear plate configured to contact the ring.

13. The BOP of claim 1, wherein:

the first piston includes a first slot and the second piston includes a second slot;

the first metal bar includes at least one protuberance to fit within and slide within the first and second slots.

14. The BOP of claim 1, wherein:

the first metal bar includes at least one of a slot or a protuberance;

the first piston includes another of the at least one of a slot or a protuberance and is slidingly engaged with the first metal bar via the slot and protuberance;

the second metal bar does not slidingly engage with the first piston via slot or protuberance.

15. The BOP of claim 1 wherein the first and second pistons have identical forms to each other.

16. The BOP of claim 1 wherein the upper surface of the ring is frustoconical and the lower surface of the ring is frustoconical.

17. The BOP of claim 1 comprising:

a first axis that traverses the channels of the body, the ring, and the first and second pistons but does not intersect any of the body, the ring, or either of the first or second pistons;

a sub-assembly that includes the first and second pistons and the resilient ring;

wherein:

a second axis is orthogonal to the first axis and intersects the resilient ring;

the sub-assembly is symmetrical above and below the second axis.

18. The BOP of claim 17, wherein the second axis bisects the resilient ring.

19. The BOP of claim 18 comprising an additional ring, wherein:

the additional ring is between portions of the first and second pistons;

a third axis, which is parallel to the first axis, intersects the first and second pistons and the additional ring.

* * * * *